US010012412B2

(12) United States Patent
Van Wyk et al.

(10) Patent No.: US 10,012,412 B2
(45) Date of Patent: Jul. 3, 2018

(54) FLUID HEATER

(75) Inventors: Dennis Allen Van Wyk, Eugene, OR (US); Russel Duane Van Wyk, Cary, NC (US); Leslie Judson Jones, Greenville, SC (US)

(73) Assignee: HEAT SOLUTIONS, INC., Eugene, OR (US)

( * ) Notice: Subject to any disclaimer, the term of this patent is extended or adjusted under 35 U.S.C. 154(b) by 1133 days.

(21) Appl. No.: 12/883,436

(22) Filed: Sep. 16, 2010

(65) Prior Publication Data

US 2011/0061609 A1 Mar. 17, 2011

Related U.S. Application Data

(60) Provisional application No. 61/242,874, filed on Sep. 16, 2009.

(51) Int. Cl.
*F24H 9/20* (2006.01)
*F24H 1/36* (2006.01)
(Continued)

(52) U.S. Cl.
CPC ..... *F24H 1/36* (2013.01); *F23L 7/002* (2013.01); *F23N 1/082* (2013.01); *F24H 9/2035* (2013.01); *F23C 2900/99009* (2013.01)

(58) Field of Classification Search
USPC ..... 122/14.22, 44.2, 52, 236, 459
See application file for complete search history.

(56) References Cited

U.S. PATENT DOCUMENTS 473,251 A 4/1892 Cox
744,042 A 11/1903 Burk
(Continued)

FOREIGN PATENT DOCUMENTS

JP 2007178057 A 7/2007
WO 2000050821 A1 8/2000

OTHER PUBLICATIONS

PCT International Search Report, dated Nov. 5, 2010.
(Continued)

*Primary Examiner* — Nathaniel Herzfeld
(74) *Attorney, Agent, or Firm* — Jay M. Brown

(57) ABSTRACT

A fluid heater comprises an enclosed combustion chamber, at least one burner operatively coupled to the enclosed combustion chamber and a heat transfer section. The heat transfer section has a first end operatively coupled to the enclosed combustion chamber, a second end, an outer wall defining a closed chamber therein, a fluid inlet port coupled to the outer wall in fluid communication with the chamber and a fluid outlet port coupled to the outer wall in fluid communication with the chamber. A plurality of tubes have an opened first end, an opposite opened second end and a chamber extending therebetween, wherein the plurality of tubes are mounted within the heat transfer section so that an outside wall of each of the plurality of tubes and an inside wall of the heat transfer section define the closed chamber. Each of the tube chambers are in fluid communication with the enclosed combustion chamber. A negative pressure source is operatively coupled to the heat transfer section second end and is in fluid communication with each of the plurality of tube chambers, where a continuous flow of hot fluid is produced at the heat transfer section fluid outlet port.

23 Claims, 6 Drawing Sheets

(51) Int. Cl.
*F23L 7/00* (2006.01)
*F23N 1/08* (2006.01)

(56) References Cited

U.S. PATENT DOCUMENTS

| | | | | | |
|---|---|---|---|---|---|
| 797,107 | A * | 8/1905 | Haarmann | 122/52 | |
| 1,488,359 | A * | 3/1924 | Lopez | 122/52 | |
| 3,392,711 | A * | 7/1968 | Wolfersperger | 122/52 | |
| 3,793,994 | A * | 2/1974 | Olsen | F22B 33/08 | 122/52 |
| 4,030,302 | A | 6/1977 | Mankouski | | |
| 4,189,295 | A * | 2/1980 | Ramon | F23N 3/065 | 431/12 |
| 4,207,840 | A | 6/1980 | Dauvergne | | |
| 4,470,359 | A * | 9/1984 | Smith | 110/234 | |
| 4,493,637 | A | 1/1985 | Ganter et al. | | |
| 4,869,208 | A | 9/1989 | Adams | | |
| 4,938,204 | A | 7/1990 | Adams | | |
| 5,022,352 | A | 6/1991 | Osborne et al. | | |
| 5,271,215 | A * | 12/1993 | Guillet | 60/39.5 | |
| 5,902,098 | A | 5/1999 | Park | | |
| 5,968,320 | A | 10/1999 | Sprague | | |
| 6,032,616 | A * | 3/2000 | Jones | A47L 11/34 | 122/32 |
| 6,053,130 | A | 4/2000 | Shellenberger | | |
| 6,394,042 | B1 * | 5/2002 | West | 122/32 | |
| 6,508,645 | B1 | 1/2003 | George | | |
| 6,585,785 | B1 * | 7/2003 | Warren et al. | 48/127.9 | |
| 2001/0051321 | A1 * | 12/2001 | La Fontaine | F23N 1/022 | 431/12 |
| 2002/0162320 | A1 * | 11/2002 | Uchida | F02D 37/02 | 60/284 |
| 2008/0011245 | A1 * | 1/2008 | Donnelly | F24H 9/2035 | 122/14.2 |
| 2009/0101085 | A1 | 4/2009 | Arensmeier et al. | | |
| 2009/0151653 | A1 | 6/2009 | Mullen | | |
| 2012/0137989 | A1 * | 6/2012 | Van Wyk et al. | 122/236 | |

OTHER PUBLICATIONS

PCT Written Opinion of the International Searching Authority, dated Nov. 5, 2010.
"Series X PowerFlameX4—The Versatile 4" Diameter Burner," 2001, 2pp., X4-0101 Rev. 0303, published by Power Flame Incorporated, Parsons, Kansas; downloaded from www.powerflame.com.
"Triangle Tube Prestige Condensing Water Boiler Service Technician's Trouble Shooting Guide," May 11, 2009, 44pp.
"Triangle Tube Engineering Submittal Prestige Solo 110," Feb. 15, 2012, 2pp.
"Triangle Tube Prestige Solo 110 Water Boiler Installation and Maintenance Manual," May 29, 2012, 89pp.
"Triangle Tube Engineering Submittal Prestige Solo 299," Jul. 1, 2016, 2pp.
"Prestige Solo 60, 110, Excellence Service Parts Instructions," Feb. 25, 2014, 14pp.
"Triangle Tube Suggested Specifications Prestige Solo 175," Jan. 16, 2013, 5pp.
"Prestige User's Information Manual," Jan. 7, 2014, 36pp.
"Prestige Solo Condensing High Efficiency Gas Boiler," Oct. 24, 2013, 4pp.

* cited by examiner

FLUID HEATER

CLAIM OF PRIORITY

This application claims priority to U.S. Provisional Application Ser. No. 61/242,874, filed on Sep. 16, 2009, the entire disclosure of which is incorporated by reference herein.

FIELD OF THE INVENTION

The present invention relates generally to heaters. More particularly, the present invention relates to gas operated fluid heater.

BACKGROUND

Typical hot water heaters contain a tank in which gas is used for heating the water. Normally, most hot water heaters have a storage tank for maintaining a given volume of water at a pre-determined temperature for use on demand. One problem with these types of heaters is that a substantial amount of energy is required for maintaining the stored water at a predetermined temperature.

Additionally, hot water heaters are available that use coils for heating water upon demand. However, there is the delay between the time that the demand is made and when a supply of heated water can be produced, in addition to the amount of heated fluid that can be produced. Moreover, the efficiency of such heaters may also be improved.

SUMMARY OF THE INVENTION

The present invention recognizes and addresses disadvantages of prior art constructions and methods, and it is an object of the present invention to provide a fluid heater comprising an enclosed combustion chamber, at least one burner coupled to the enclosed combustion chamber and a heat transfer section. The heat transfer section has a first end operatively coupled to the enclosed combustion chamber, a second end, an outer wall defining a closed chamber therein, a fluid inlet port coupled to the outer wall and in fluid communication with the chamber and a fluid outlet port coupled to the outer wall and in fluid communication with the chamber. A plurality of tubes have an opened first end, an opposite opened second end and a chamber extending therebetween, wherein the plurality of tubes are mounted within the heat transfer section so that an outside wall of each of the plurality of tubes and an inside wall of the heat transfer section define the closed chamber, and each of the tube chambers are in fluid communication with the enclosed combustion chamber. A negative pressure source is operatively coupled to the heat transfer section second end and is in fluid communication with each of the plurality of tube chambers, where a continuous flow of hot fluid is produced at the heat transfer section fluid outlet port.

In some embodiments, each of the plurality of tubes is coiled within the heat transfer section. In other embodiments, the enclosed combustion chamber walls are formed from an inner wall spaced apart from an outer wall which together define a cavity therebetween. In these embodiments, the heat transfer section fluid output port is operatively coupled to an inlet port in fluid communication with the combustion chamber wall cavity.

In yet other embodiments, a water source is coupled to the enclosed combustion chamber for injecting a water mist into the at least one burner. In other embodiments, a microprocessor is operatively coupled to the at least one burner, the heat transfer section and the vacuum source. In these embodiments, a control valve is coupled to the at least one burner, the control valve being operatively coupled to the microprocessor so that the flow of fuel to the at least one burner can be adjusted based on a measured output temperature of fluid at the heat transfer section fluid outlet port.

In yet other embodiments, the at least one burner is configured to burn a combustible fuel. In other embodiments, the burners are configured to burn a biomass fuel.

In some embodiments, wherein the fuel flow to the at least one burner is modulated.

In still other embodiments, an air flow sensor is mounted proximate the heat transfer section second end for detecting air flow through the heat transfer section, and a fluid flow sensor is mounted proximate the heat transfer section inlet port for detecting fluid flow into the heat transfer section. In these embodiments, the air flow sensor and the fluid flow sensor are operatively coupled to the microprocessor.

In other embodiments, the water source is a condensation trap operatively coupled to the heat transfer section proximate the heat transfer section second end.

In yet another preferred embodiment, a fluid heater comprises an enclosed combustion chamber, at least one burner operatively coupled to the enclosed combustion chamber, a first heat transfer section having a first end operatively coupled to the enclosed combustion chamber, a second end, an outer wall defining a closed chamber therein, and a plurality of tubes having an opened first end, an opposite opened second end and a chamber extending therebetween, wherein the plurality of tubes are mounted within the first heat transfer section so that an outside wall of each of the plurality of tubes and an inside wall of the first heat transfer section define the closed chamber, and a negative pressure source operatively coupled to the first heat transfer section second end and in fluid communication with each of the plurality of tube chambers and a fan operatively coupled to said at least one burner.

In some embodiments, a plurality of burners are operatively coupled to the enclosed combustion chamber.

In some embodiments, the fluid heater has a second heat transfer section having a first end operatively coupled to the enclosed combustion chamber, a second end, an outer wall defining a closed chamber therein, and a plurality of tubes having an opened first end, an opposite opened second end and a chamber extending therebetween, wherein the plurality of tubes are mounted within the second heat transfer section so that an outside wall of each of the plurality of tubes and an inside wall of the second heat transfer section define the closed chamber.

In other embodiments, a fluid source is operatively coupled to the first heat transfer section proximate the first heat transfer section second end, and the second heat transfer section proximate the second heat transfer section second end.

In yet other embodiments, the first heat transfer section plurality of tube first ends and the second heat transfer section plurality of tube first ends are in fluid communication with the enclosed combustion chamber.

In still other embodiments, a microprocessor is operatively coupled to the plurality of burners, the first heat transfer section, the second heat transfer section and the at least one of the vacuum source and the fan. In these embodiments, the microprocessor is configured to regulate the flow of fuel to the at least one burner based on a measured temperature of fluid at a respective output port of the first and the second heat transfer sections.

In yet another embodiment, the negative pressure source is a vacuum pump.

In still another preferred embodiment, a fluid heater comprises a combustion chamber, a plurality of burners mounted in the combustion chamber, a first heat transfer section having at least one bore formed therein, wherein the bore has a first end in fluid communication with the combustion chamber and an opposite second end, and the first heat transfer section defines a chamber between a wall defining the at least one bore and an outside wall of the first heat transfer section, a second heat transfer section having at least one bore formed therein, wherein the bore has a first end in fluid communication with the combustion chamber and an opposite second end, and the second heat transfer section defines a chamber between a wall defining the at least one bore and an outside wall of the second heat transfer section, and at least one of a vacuum source operatively coupled to the first heat transfer section bore second end and the second heat transfer section bore second end, a fan operatively couple to the at least one burner for introducing air flow into said enclosed combustion chamber.

In some embodiments, a microprocessor is operatively coupled to the at least one burner, the first heat transfer section, the second heat transfer section and the at least one vacuum source and the fan, the microprocessor being programmed to regulate the flow of fuel to the at least one burner based on a measured temperature of fluid at a respective output port of the first and the second heat transfer sections. In yet other embodiments, the first and the second heat transfer sections further comprises a plurality of bores formed therein.

Various combinations and sub-combinations of the disclosed elements, as well as methods of utilizing same, which are discussed in detail below, provide other objects, features and aspects of the present invention.

The accompanying drawings, which are incorporated in and constitute a part of this specification, illustrate one or more embodiments of stacked displays of the present invention.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
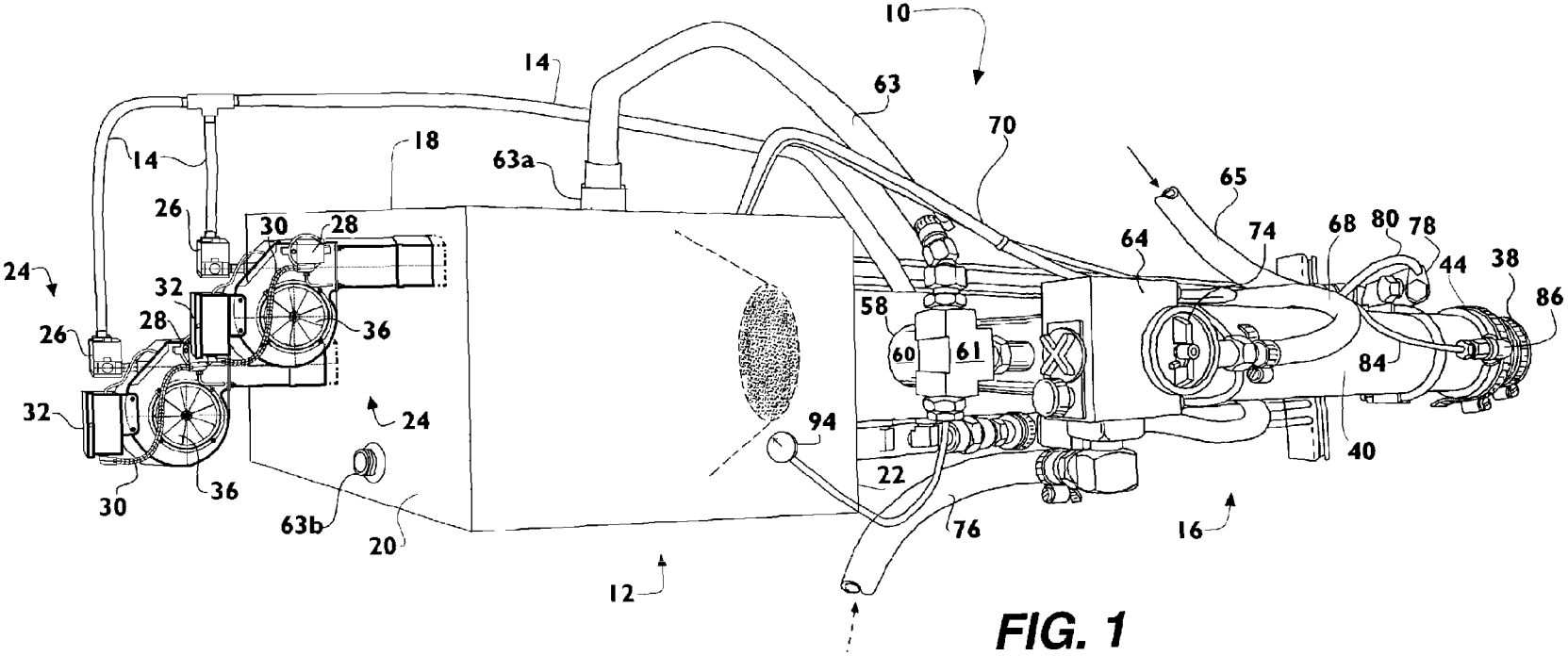
FIG. 1 is a perspective view of an embodiment of a fluid heater in accordance with one embodiment of the present invention.

Repeat use of reference characters in the present specification and drawings is intended to represent same or analogous features or elements of the invention according to the disclosure.

DETAILED DESCRIPTION OF THE PREFERRED EMBODIMENT

Reference will now be made in detail to presently preferred embodiments of the invention, one or more examples of which are illustrated in the accompanying drawings. Each example is provided by way of explanation, not limitation, of the invention. It is to be understood by one of ordinary skill in the art that the present discussion is a description of exemplary embodiments only, and is not intended as limiting the broader aspects of the present invention, which broader aspects are embodied in the exemplary constructions. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
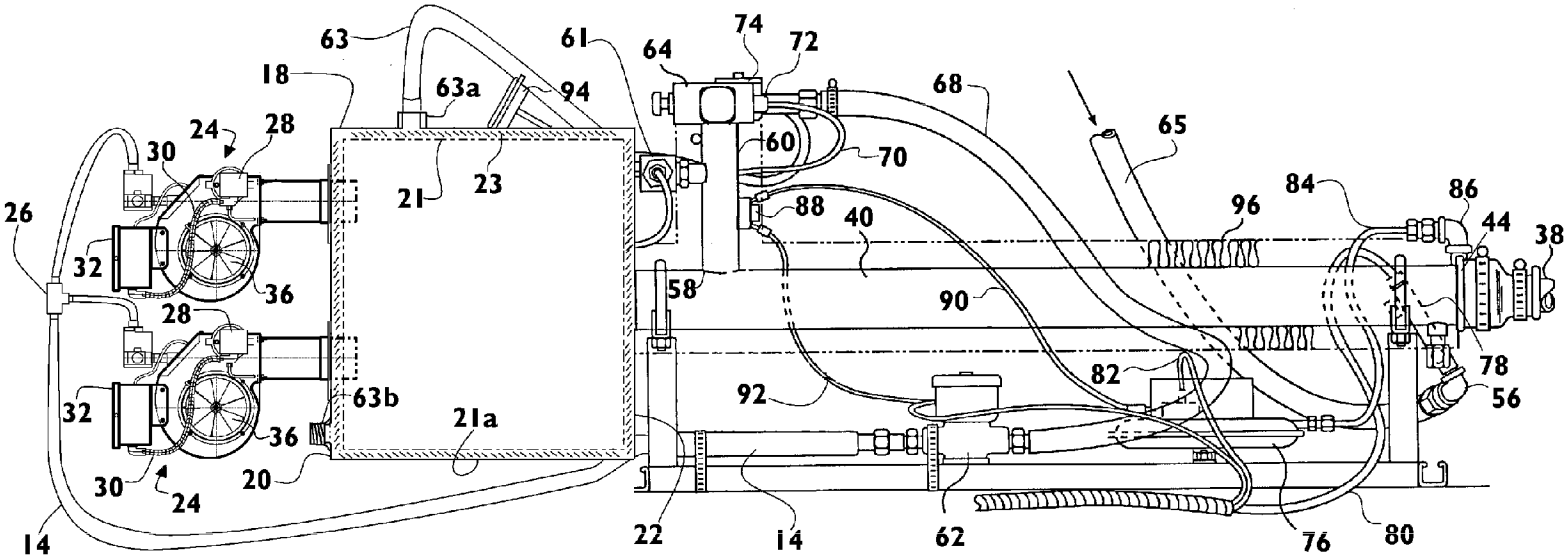
FIG. 2 is a side view of fluid heater shown in FIG. 1.
Figure 3:
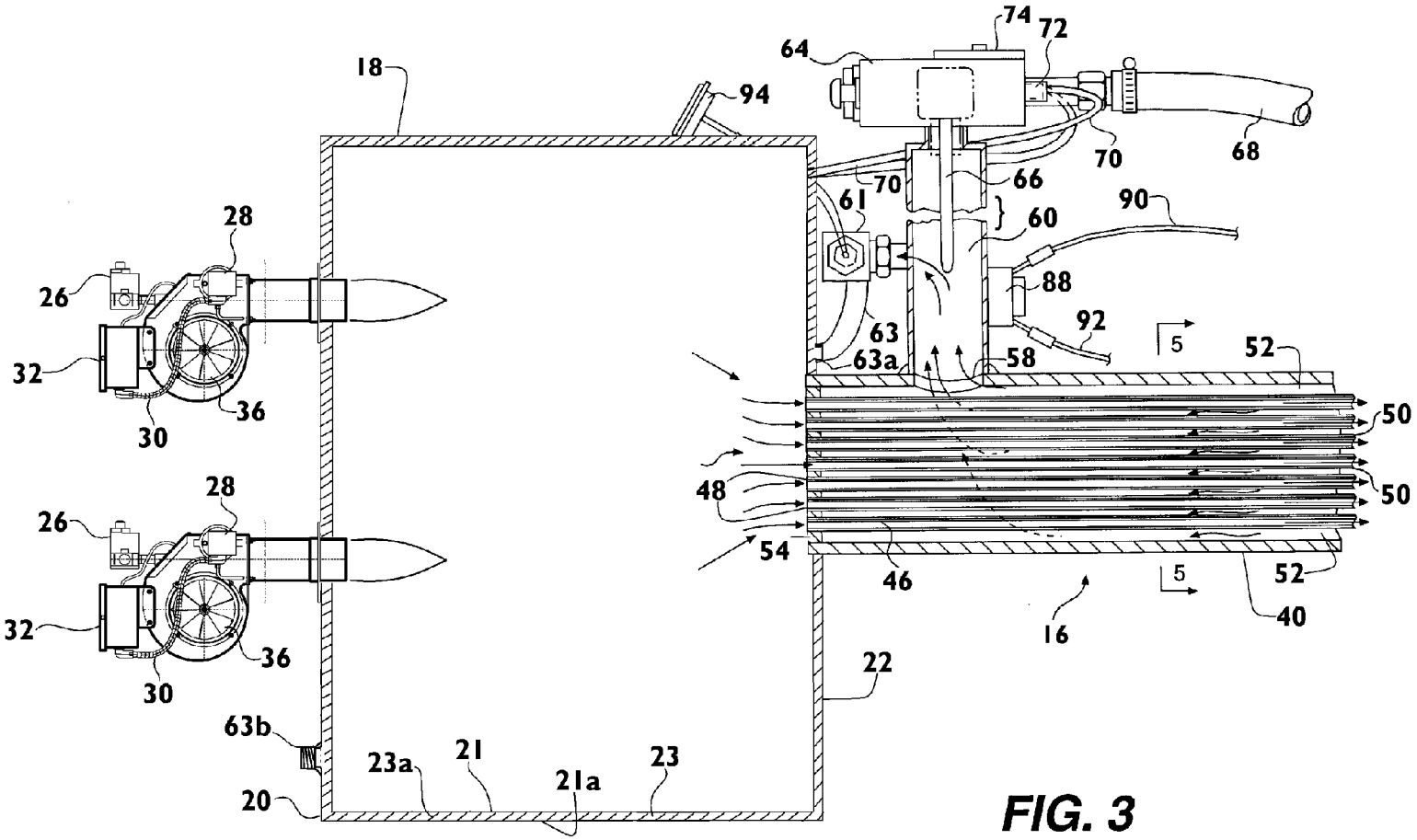
FIG. 3 is a partial side view, in partial cutaway, of the fluid heater shown in FIG. 1.
Figure 5:
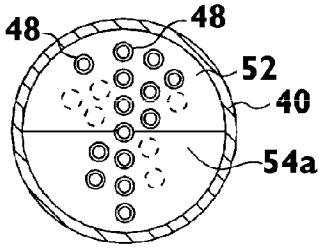
FIG. 5 is a cross-sectional view of the heat exchange section of FIG. 4.

Referring to FIGS. 1-3, a heater 10 is shown having a closed combustion chamber, generally denoted at 12, a source of fuel 14 and a heat transfer section, generally denoted at 16. Closed combustion chamber 12 is formed from a substantially enclosed chamber 18. In one preferred embodiment, chamber 18 is rectangular in shape with a first end 20 and a second end 22. The walls of enclosed combustion chamber 18 may be formed from metals, metal alloys, ceramics, polymers or other suitable materials. In one preferred embodiment, the walls of chamber 18 are formed from an inner wall 21 (FIG. 2) and a spaced apart outer wall 21*a* (FIG. 2) that together define a chamber 23 (FIG. 2) therebetween. Baffles 23*a* are positioned within combustion chamber cavity 23.

One or more burners 24 are coupled to enclosed chamber 18. In one preferred embodiment, burner 24 is a Power Flame X4 burner manufactured by Power Flame Incorporated of Parsons, Kans. Each burner 24 has a respective valve 28 intermediate the burner and a manifold 26. Valve 28 allows the fuel supply to be cut-off from the burner by way of control lines 30 connected to a controller 32. In this way, each burner may be run alone, in parallel or in series with other burners to regulate the amount of heat generated in chamber 18. Each burner 24 may have an electronic computer controlled pilot light (not shown) associated with the burner. Each burner may be a fixed BTU burner or a modulating burner. A fan 36 is coupled to burner 24 and functions to provide positive air pressure to burner 24.

Enclosed combustion chamber 18 in one preferred embodiment is rectangular in shape. However, in other embodiments, the cross-section of the combustion chamber may be square, polygonal, oval or circular depending on the application of the heater. In all embodiments, it is important to understand that airflow into enclosed combustion chamber 18 must be controlled to increase the efficiency of combustion of the fuel delivered to burner 24. That is, the construction of enclosed combustion chamber 18 is designed to increase the efficiency of fuel burn while decreasing the byproducts of fuel combustion exhausted into the atmosphere. Through testing, it has been determined that the amount of excess air in enclosed combustion chamber 18 directly affects the efficiency of fuel burn. For example, the following table provides testing data illustrating the effects of excess air in combustion chamber 18.

| Excess Air | Efficiency % | Stack Temp (F.) | Amb. Temp. (F.) | $O_2$ % | $CO_2$ % | CO % | O % COR CO % |
|---|---|---|---|---|---|---|---|
| 0 | error | 79 | 84.5 | 20.2 | Neg. | 2 ppm | error |
| 30.8 | 98.8 | 89 | 88 | 5.3 | 10.3 | 55 ppm | 73 ppm |
| 34.84 | 98.4 | 91 | 81.5 | 5.8 | 10 | 11 ppm | 15 ppm |

-continued

| Excess Air | Efficiency % | Stack Temp (F.) | Amb. Temp. (F.) | $O_2$ % | $CO_2$ % | CO % | O % COR CO % |
|---|---|---|---|---|---|---|---|
| 39.99 | 99 | 86 | 87.5 | 6.4 | 9.6 | 183 ppm | 263 ppm |
| 43.74 | 99.6 | 80 | 81.5 | 6.8 | 9.3 | 19 ppm | 28 ppm |

From the above table, a controlled introduction of excess air into enclosed combustion chamber 18 increases the efficiency of fuel burn while minimizing $CO_2$ and CO byproducts. In particular, in choosing the amount of excess air, the amount of $CO_2$ should remain preferably under 100 ppm and more particularly below 50 ppm while the efficiency is above 98%. In this configuration, exhaust (stack) temperature remains within a few degrees of ambient temperature.

In one preferred embodiment, heat transfer section 16 is an elongated cylinder 40 having a first end 42 (FIG. 3) and second end 44. Heat transfer section first end 42 is configured to couple to enclosed combustion chamber second end 22 by a clamp, connector or other suitable attachment means such as weldments. In some embodiments, enclosed combustion chamber 18 and heat transfer section 16 may be integrally formed with one another. It should be understood that in other preferred embodiments, heat transfer section 16 may be formed in the shape of an elongated polygonal shaped body or other suitable form based on the devices intended use.

Referring particularly to FIG. 3, elongated cylinder 40 is hollow and contains a plurality of hollow tubes 46 having a first open end 48 opening into closed combustion chamber 18 and a second open end 50 that opens to a negative pressure source, which in one preferred embodiment is a vacuum pump 38. Elongated cylinder 40 may be formed from any suitable material such as metal, metal alloys, ceramics or polymers. Hollow tubes 46 may be formed from any heat conducting material such as metals, metal alloys, ceramics, polymers and other suitable materials. The length of tubes 46 may be less than or equal to the length of elongated cylinder 40, or in some embodiments, may be longer if the tubes are zigzagged or coiled within elongated cylinder 40. It should be understood that a cross-section of tubes 46 taken perpendicular to their length may be of various shapes, including by not limited to, a circle, a square, and other polygonal shapes. The number of tubes may also increase or decrease based on the outer diameter of each individual tube.

The number of tubes and the physical dimension of the tubes defines a space 52, intermediate an outside surface of tubes 46 and an inner wall of elongated cylinder 40, that is sealed off from closed combustion chamber 18 and vacuum pump 40. Closed space 52 defines a chamber in which a fluid may be pumped through so that heat received in tubes 46 from closed combustion chamber 18 may be exchanged into the fluid via the tube walls. Tubes 46 are held in place in elongated cylinder 40 by a plate 54 that defines a plurality of holes (not numbered) that receive a respective tube first open end 46. Each tube first open end 46 may be secured in a respective plate opening by welding or other suitable means that forms a sealed attachment. A similar plate 54 (FIG. 4) is positioned at heat transfer section second end 42 for securing and sealing tube second ends 50.

In other embodiments, heat transfer section 16 may be formed from a hollow cylinder that defines at least one bore extending from one end to the other. In this embodiment, an outside wall defining the bore and an inside wall of the hollow cylinder defines space 52. In this embodiment, a plurality of bores may be formed to increase the surface area exposed to combustion chamber 18.

Figure 4:
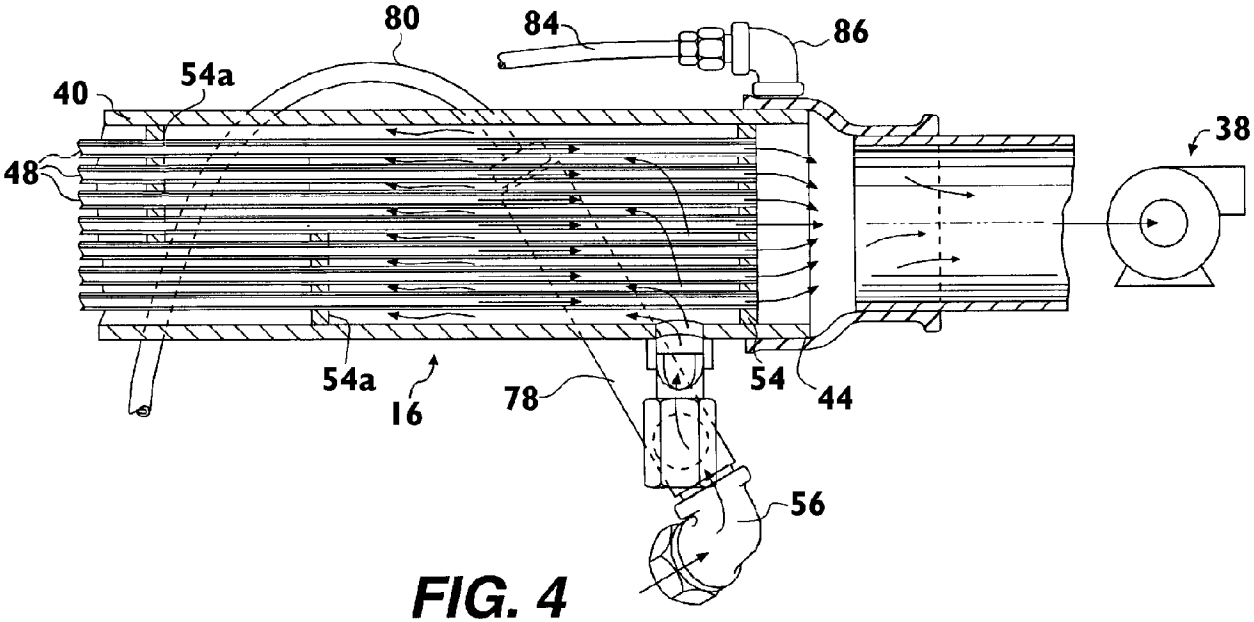
FIG. 4 is a partial side view of a heat exchange section of the fluid heater shown in FIG. 1.

Referring to FIG. 4, a water circulation system is operatively coupled to elongated cylinder 40 at an inlet port 56 that allows a liquid to enter elongated cylinder 40 into space 52. A hose 65 (FIG. 1) or other suitable pressurized supply of fluid is coupled to inlet port 56. The fluid enters into space 52 and exits through an outlet port 58 (FIG. 2) into a manifold 60. The fluid passes through manifold 60 (FIG. 2) and out a coupling 61 to an output hose 63 (FIGS. 1 and 2). As fluid circulates around the outer surface of tubes 46, heat is transferred through the walls of the tube thereby rapidly heating the fluid.

In one preferred embodiment, Output hose 63 is coupled to an input 63*a* formed in combustion chamber 18. That is, as heated fluid exits heat exchanger 16, it is pumped through combustion chamber wall cavity 23 (FIG. 2). Baffles 23*a* help to disburse the fluid around combustion chamber 18 and out a port 63*b*. Pumping the fluid around combustion chamber 18 helps to reduce heat radiated from combustion chamber 18. In other embodiments, fluid exiting through hose 63 may be directly supplied to the end user without being pumped through combustion chamber wall cavity 23. It should be understood that in addition to, or instead of a fluid jacket defined by combustion wall cavity 23, insulation material may be placed on inner combustion chamber wall 21 facing the inside of combustion chamber 18 and on the outside of outer combustion chamber wall 21*a*. Such insulation may take the form of heat resistant insulation, ceramics, or other suitable materials. For example, in one preferred embodiment, a insulation material may be placed adjacent to the inner wall of enclosed combustion chamber 18. Next, a fluid jacket may be positioned adjacent to the insulation layer so that one side of the fluid jacket faces the inside of the combustion chamber. In this configuration, the fluid jacket transfers a majority of the radiated heat into the fluid passing through the jacket. Any residual heat is absorbed by the insulation layer leaving the outer chamber wall cool to the touch. In other embodiments, a single wall enclosure may be implemented having a copper coil mounted adjacent to the inside of the outer wall, where fluid from the heat transfer section is pumped through the coil to reduce heat produced in the enclosed combustion chamber.

Referring to FIG. 2, fuel is input through a hose 76 that connects to a control valve 64. Suitable fuel may be propane, natural gas, biomass fuel or any other combustible fuel. An output hose 68 is coupled to control valve 64 at one end and to a solenoid valve 62 at the other. Solenoid valve 62 controls the flow of fuel from the fuel source to burners 24. When solenoid valve 62 is activated, gas flows through hose 14 to fuel manifolds 26. Gas control valve 64 has a built-in thermostat that is activated by a sensor 66 (FIG. 3) located in output manifold 60. Sensor 66 senses the temperature of heated fluid passing through output manifold 60. If the temperature of the fluid is below a set temperature, gas is allowed to flow through gas control valve 64 through line 68 to solenoid valve 62. Gas control valve 64 also supplies gas by means of a line 70 to the pilot lights (not shown).

A thermal coupler 72 (FIG. 2) associated with the pilot lights (not shown) send a signal to gas control valve 64 if the pilot light goes out or fails to ignite. Gas control valve 64 contains a knob 74 to adjust the flow of gas through the gas control valve to allow the user to adjust the temperature of fluid passing through output manifold 60. Heater 10 is provided with various controls and safety devices to ensure that fluid is flowing through elongated tube 40 and a vacuum or positive air pressure is applied prior to igniting burners 24. Heater 10 is also provided with safety switches to shutdown the system if the fluid exceeds a predetermined temperature. In particular, heater 10 contains a vacuum switch 76 and a flow switch 78.

A source of electrical power (not shown), such as an 120 volt AC connection or a connection to a battery connects to fan 36 and/or vacuum 38 through vacuum switch 76 and flow switch 78. An on-off switch (not shown) is also provided intermediate the power source and the vacuum pump and fan to cut power to the entire system. As a result, when the on-off switch is closed, power is supplied to vacuum pump 38. When fluid is introduced into heater 10, the fluid is fed through hose 65 to inlet port 56. The fluid passes across flow switch 78 and into elongated cylinder space 52. As water flows past flow switch 78, it allows current to pass through the flow switch and over a lead 80 into vacuum switch 76 over a lead 82. Another input lead 84 couples vacuum switch 76 to a sensor 86, located at elongated cylinder second end 44, in fluid communication with elongated cylinder space 52. As a result, before vacuum switch 76 opens to allow current to pass to vacuum 38, a predetermined rate of air flow must be detected at elongated cylinder second end 44.

When airflow is detected by sensor 86, electricity is permitted to flow through vacuum switch 76 to a temperature limit switch 88 over a lead line 90. Temperature limit switch 88 can be set to any desired setting and is responsive to the temperature in manifold 60 through which the hot fluid passes as it exits from the heat transfer section. If the temperature of the fluid exiting from heat transfer section 16 is below a cut-off setting of thermal switch 88, then current is allowed to flow to solenoid valve 62 over a lead line 92. Thus, solenoid valve 62 allows fuel to flow via fuel line 14 to burners 24 to continue heating the fluid.

If no air flow is detected from vacuum 38, then heater 10 cannot be operated. Similarly, if no fluid is supplied to heater 10, it will not activate flow switch 80, which in turn activates vacuum switch 76. Vacuum switch 76 must also be activated to turn on solenoid valve 62, which in turn, controls the flow of gas to the burners. Thus, safety measures ensure that the system will not operate if fluid or vacuum pressure is not detected.

A temperature gauge 94 is provided for indicating the output temperature of the fluid. In order to increase the efficiency of heater 10, an insulated jacket 96 of any suitable construction (including a jacket of the fluid itself), can be wrapped around elongated pipe 40 as well as the combustion chamber. It should be understood that other suitable insulation methods may be employed depending on the end use of the heater.

While the above description is directed to the heating of a fluid, one of skill in the art should understand that heater 10 may also be used to create steam in a similar manner. In the case of steam production, the design of the heat transfer section would reflect the increase in pressure necessary in creating steam. The steam output can then be used for heating of a space, the production of electricity or for any other suitable purpose.

Figure 6:
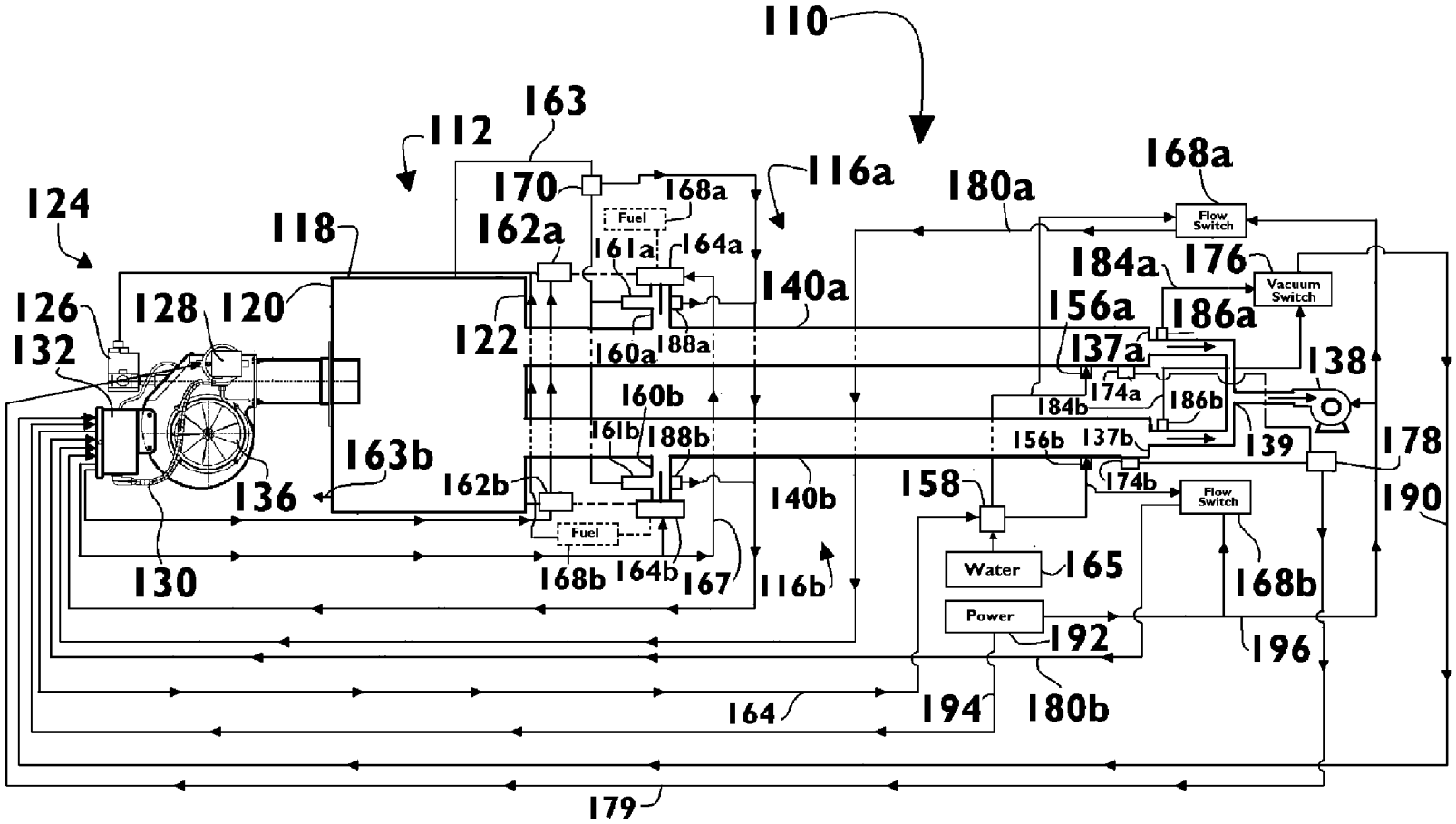
FIG. 6 is a schematic view of an embodiment of a fluid heater in accordance with one embodiment of the present invention.

Referring to FIG. 6, in another preferred embodiment, a heater 110 is shown having a substantially closed heating chamber 112, a first heat transfer section 116*a* and a second heat transfer section 116*b*. Substantially closed heating chamber 112 contains an enclosure 118 having a first end 120 and a second end 122. Enclosure 118 may be formed in a variety of shapes, for example, square, rectangular, cylindrical, and may be formed from any suitable material such as metals, metal alloys, ceramics and polymers. Enclosure 118 may be a single wall enclosure or in some embodiments the enclosure may be formed from a double wall construction and have insulation material between the spaced apart walls to maintain the outside wall at a lower temperature than the combustion chamber. It should be understood that while insulation in the form of a material or fluid may be placed between the inner and outer walls of the combustion chamber, insulation may also be adhered to the inside wall of the inner wall and the outside wall of the outer wall of the combustion chamber.

It should also be understood that the material of the outer wall may differ from the material of the inner wall of the double wall construction. In some embodiments similar to those shown in the previous figures, a cavity may be formed between the inner and outer walls so that heated fluid from heat transfer sections 116*a* and 116*b* may be diverted into the combustion chamber cavity to cool the walls of the combustion chamber. In these embodiments, the fluid cools the walls by transferring additional heat into the fluid, which is then output at an output port 163*a*.

Mounted to enclosure 118 is a burner 124 operatively coupled to a fuel manifold 126. In some embodiments, multiple burners may be used depending on the application of the heater. Burner 124 connects to fuel manifold 126 by a programmable control valve 128. A fuel delivery line 114 couples to fuel manifold 126. A pilot light (not shown) is configured to ignite burner 124. A microprocessor 132 is connected to control valve 132 by control line 130. Microprocessor 132 is programmed to control the fuel flow into burner 124 through control valve 128. Microprocessor 132 is also operatively connected to the pilot light (not shown) and is programmed to control the operation of pilot lights 134.

First and second heat transfer sections 116*a* and 116*b* are in fluid communication with enclosure second end 122. First and second heat transfer sections 116*a* and 116*b* are each formed from a respective elongated chamber 140*a* and 140*b*. In one preferred embodiment, elongated chambers 140*a* and 140*b* are in the form of a cylindrical chamber. It should be understood that in some embodiments, elongated chambers 140*a* and 140*b* may be formed by a single wall construction, and in other embodiments, the chambers may be formed from a double wall construction. Elongated chambers 140*a* and 140*b* may be formed from any suitable material such as metals, metal alloys, ceramics and polymers depending on the use of heater 110.

Figure 6A:
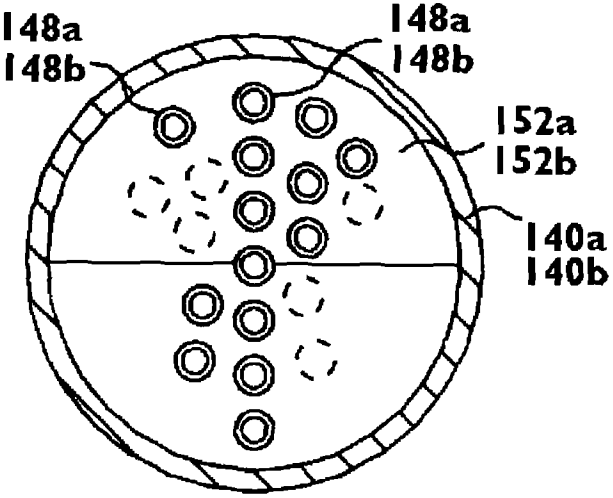

Similar to the embodiment described with respect to FIGS. 1-5, a plurality of tubes 148*a* and 148*b* (FIG. 6A) are contained within each respective elongated chamber 140*a* and 140*b*. It should be understood that FIG. 6A illustrates a cross-section of a single heat transfer section, but contains reference numbers indicative of each heat transfer section. Each of the plurality of tubes has a first open end (not shown) in fluid communication with the combustion chamber in enclosure 118. An opposite second open end (not shown) of the tubes are in fluid communication with a respective exhaust end 137*a* and 137*b* of the respective elongated chambers 140*a* and 140*b*. Each exhaust end 137*a* and 137*b* is coupled to a Y-shaped manifold 139 that connects to a negative pressure source, in one preferred embodiment a vacuum pump 138. In other embodiments, a fan may be sufficient to create negative pressure through heat transfer sections 116*a* and 116*b* and in combustion chamber 118. Referring to FIG. 6, a chamber 152*a* and 152*b* is defined in each of heat transfer sections 116*a* and 116*b* in the space between an inner wall of elongated cylinders 140*a* and 140*b* and the outer walls of the respective tubes 148*a* and 148*b*.

A vacuum switch is operatively coupled to a first flow sensor 186*a*, by a control line 184*a*, in one portion of manifold 139, and is operatively coupled to a second flow sensor 186*b*, by a control line 184*b*, in another portion of manifold 139. Flow sensors 186*a* and 186*b* are configured to detect air flow out of respective elongated chamber exhaust ends 137*a* and 137*b*. Vacuum switch 176 is operatively coupled to microprocessor 132 by a control line 190. In some embodiments, Y-shaped manifold 139 may contain a diverter (not shown) that allows vacuum pump 138 to pull a vacuum through one or both exhaust ends 137*a* and 137*b*.

Each elongated chamber 140*a* and 140*b* has a respective fluid input port 156*a* and 156*b* that is in fluid communication with a computer controlled valve 158. Computer controlled valve 158 is operatively connected to microprocessor 132 by a control line 164. Control valve 158 is also in fluid communication with a fluid source 165. In one preferred embodiment, fluid source 165 is a water supply. A first flow switch 168*a* is operatively coupled to first enclosure input port 156*a*, and a second flow switch 168*b* is operatively coupled to second enclosure input port 156*b*. Each flow switch is configured to detect the flow of fluid entering its respective input port. Each of fluid input ports 156*a* and 156*b* are in fluid communication with a respective heat transfer chamber 152*a* and 152*b*.

Each elongated chamber 140*a* and 140*b* has a respective output manifold 160*a* and 160*b* in fluid communication with a respective heat transfer section chamber 152*a* and 152*b*. Each manifold has a respective output port 161*a* and 161*b* that connects to a fluid output line 163. A flow sensor 170 is operatively coupled to fluid output line 170 and connects to microprocessor 132 via a control line 172. Each output manifold 160*a* and 160*b* has a temperature sensor 188*a* and 188*b*, respectively. Temperature sensors 188*a* and 188*b* are connected to microprocessor 132 via control line 172. In addition to the temperature sensors, each manifold has a respective gas control valve 164*a* and 164*b*. A control line 167 operatively couples each gas control valve 164*a* and 164*b* to microcontroller 132. It should be understood that although two gas control valves are illustrated in this embodiment, a single gas control valve may be used in alternative embodiments.

A source of power 192 is operatively coupled to microprocessor 132 by a power line 194. Power source 192 also provides power over a line 196 to vacuum switch 176, flow switches 168*a* and 168*b* and vacuum pump 138. Power source 192 may be a 120V AC connection, a battery, capacitor or other suitable power supply. In the embodiment shown in FIG. 6, power is supplied to these components over the various control lines coupled to microcontroller 132. Therefore, it should be understood that each control line can be configured for bi-directional communication in addition to delivering power to the devices coupled to the control lines. In other embodiments, power may also be delivered to the various computer controlled valves 158, 162*a* and 162*b* and to gas control valves 164*a* and 164*b* directly over a dedicated power line from power source 192.

In operation, when a fluid demand is detected at flow sensor 170, a signal is delivered to microprocessor 132 indicative of the demand for heated fluid. Microprocessor 132 commands the pilot light to ignite so that a flame is present before the negative pressure source creates negative pressure in one or both heat transfer sections. Depending on the detected demand rate, microprocessor 132 commands computer controlled valve 158 to either deliver fluid flow to one or both of heat transfer sections 116*a* and 116*b*. If the demand for heated fluid is below a predetermined threshold, fluid is only delivered to heat transfer section 116*a* through valve 158.

Flow switch 168*a* detects fluid flow into chamber 152*a* (FIG. 6A) and transmits a signal to microcontroller 132. Microcontroller 132 causes vacuum pump 138 to create negative pressure through Y-connector 139, which is detected by vacuum switch 176 through one or both flow sensors 186*a* and 186*b*. Vacuum switch 176 communicates a signal indicative of the flow rate to microprocessor 132 over a control line 190.

In response to fluid flow detection at input ports 156*a* and 156*b* and air flow detection by flow sensors 186*a* and 186*b*, microcontroller 132 causes gas control valve 164*a* to deliver gas to fuel manifold 126 and pilot lights 134. The microcontroller also controls the fuel flow rate at burner 124 through programmable control valve 128. Depending on the heated fluid demand rate detected at flow detector 170, burner 124 may be turned higher or lower. As heat is generated in closed combustion chamber 118, the heat is drawn through heat transfer section 116*a* by the negative vacuum pressure created by vacuum pump 138. As the heat is drawn through tubes 148*a*, heat is transferred to fluid flowing through space 152*a* (FIG. 6A). The transfer rate from the tubes into the fluid is dependant on the surface area of the tubes. The surface area may be increased by increasing the number of tubes and the length of the tubes in elongated cylinder 140*a*. Thus, surface area may be increased by coiling or zigzagging the tubes, or by changing the cross-section shape of the tubes, for example to a square or rectangular cross-section.

Heated fluid flows through the length of elongated cylinder 140*a* into output manifold 160*a*. Temperature sensor 188*a* monitors the temperature of the fluid passing through output manifold 160*a* and generates a signal that is delivered to microprocessor 132 over a control line 167. Microprocessor 132 is programmed to regulate fuel flow to fuel manifold 126 and the flow of fuel through control valve 128 based on the detected temperature at temperature sensor 188*a*. If the temperature detected at temperature sensor 188*a* is below a preset value, microprocessor 132 can increase the fuel flow to increase the heat generated in enclosure 118. If, in the alternative, the temperature of the existing fluid is above the preset value, the temperature in enclosure 118 may be decreased. In other embodiments, multiple burners may be used depending on the application of the heater.

If the demand rate detected at flow sensor 170 is greater than the predetermined value, microprocessor 132 commands valve 158 to allow fluid to flow into both heat transfer sections 116*a* and 116*b*. Similar to that described above with respect to heat transfer section 116*a*, the various components monitor the fluid flow and vacuum flow through both heat transfer sections 116*a* and 116*b*. As indicated above, fuel may be delivered through a single gas control valve coupled to fuel manifold 126 and operatively coupled to microprocessor 132. The use of two gas control valves allows for system redundancies. The heat generated in combustion chamber 118 is controlled by microprocessor 132 to ensure that the fluid flowing through heat transfer sections 116*a* and 116*b* is properly heated to the preset temperature value set by the user.

The use of two heat transfer sections in the embodiment shown in FIG. 6 allows for heater 110 to provide heated fluid based on a demand rate dictated by one or more users. That is, when the demand rate is below the predetermined threshold, heat transfer section 116*a* alone can provide efficient heating of fluid. However, if the demand is above the predetermined threshold value, the system uses the combination of heat transfer sections 116*a* and 116*b* to provide sufficient heated fluid at the required rate. Thus, heater 110 operates as a two stage fluid heater. It should be understood that more than 2 heat transfer sections may be used. For example, if heater 110 is used in an apartment building or in an industrial application where fluid demand can vary based on the number of users, the heater will operate as a multi-stage heater adding in additional heat transfer sections as heated fluid demand increases. Thus, sufficient heated fluid may be provided in an efficient on-demand manner. In other embodiments, instead of having heat transfer sections 116*a* and 116*b* in parallel, the heat transfer sections may be serially connected.

In one preferred embodiment, a condensation trap 174*a* and 174*b* is operatively coupled to a respective heat transfer section 116*a* and 116*b*. Condensation traps 174*a* and 174*b* are configured to capture condensation that builds at elongated cylinder exhaust ends 137*a* and 137*b*. In some embodiments, the trapped condensation can be fed to a pump 178, which is operatively coupled to burner 124 via a feed line 179. In this configuration, trapped condensation is pumped to a misting nozzle (not shown) that injects water mist into burner fan 136 or gas valve 128, which increases the temperature of the heat generated by burner 124. In other embodiments, water may by supplied to the misting nozzle (not shown) from fluid supply 165 or by any other suitable water supply. In any case, it has been found through experimentation that the temperature in combustion chamber 118 increases when a water mist is introduced into the burner.

While one or more preferred embodiments of the invention are described above, it should be appreciated by those skilled in the art that various modifications and variations can be made in the present invention without departing from the scope and spirit thereof. For example, the fluid heater described herein may be used in various applications such as a fluid heater for carpet cleaning, a water heater for a residential house, a water heater for an apartment building or as a water heater or even a large-scale boiler system in a commercial setting. It is intended that the present invention cover such modifications and variations as come within the scope and spirit of the appended claims and their equivalents.

What is claimed is:

1. A fluid heater, comprising:

a. an enclosed combustion chamber, being configured for causing a controlled amount of air inflow into the enclosed combustion chamber;

b. a fuel burner operatively coupled to the enclosed combustion chamber;

c. a heat transfer section having i. a first end coupled to the enclosed combustion chamber, ii. a second end, iii. an inside wall, iv. an outside wall having a closed cavity therein, v. a fluid input port coupled to the outside wall of the heat transfer section and in fluid communication with the closed cavity, and vi. a fluid output port coupled to the outside wall of the heat transfer section and in fluid communication with the closed cavity;

e. a plurality of tubes, each one of the plurality of tubes having an outside wall, an open first end, an opposite open second end, and an open chamber extending between the open first and second ends of the tube, wherein the plurality of the tubes are mounted within the heat transfer section so that the outside walls of the plurality of tubes and the inside wall of the heat transfer section together define the closed cavity, and wherein the open chambers of the tubes are in fluid communication with the enclosed combustion chamber; and f. a negative pressure source being coupled to the second end of the heat transfer section and being in fluid communication with each one of the plurality of the open chambers of the tubes, and the negative pressure source being configured for causing a controlled amount of air outflow from the enclosed combustion chamber through the tubes of the heat transfer section;

wherein the fluid heater is configured for maintaining a selected amount of air in the enclosed combustion chamber, by the enclosed combustion chamber being configured for causing the controlled amount of the air inflow, together with the negative pressure source being configured for causing the controlled amount of the air outflow through the tubes of the heat transfer section.

2. The fluid heater of claim 1, wherein the enclosed combustion chamber has an outside wall including an enclosed fluid passageway having a fluid input port and a fluid output port, wherein the fluid input port of the enclosed fluid passageway is in fluid communication with the fluid output port of the heat transfer section, and wherein the fluid heater is configured for causing a heated fluid to flow from the closed cavity to the enclosed fluid passageway.

3. The fluid heater of claim 1, further including a fluid chamber having a fluid input port and a fluid output port and being in proximity to the enclosed combustion chamber, wherein the fluid output port of the heat transfer section is in fluid communication with the fluid input port of the fluid chamber, and wherein the fluid heater is configured for causing a heated fluid to flow from the closed cavity of the heat transfer section through the fluid chamber, and to thereby cause the heated fluid to be further heated while being in proximity to the enclosed combustion chamber.

4. The fluid heater of claim 1, wherein the negative pressure source includes a fan or a vacuum pump.

5. The fluid heater of claim 1, further including a microprocessor operatively coupled to the fuel burner, and to the heat transfer section, and to the negative pressure source.

6. The fluid heater of claim 1, further including a microprocessor being operatively coupled to the fuel burner, and to the heat transfer section, and to the negative pressure source; wherein the microprocessor is configured for controlling the air inflow and the air outflow in response to a measurement taken at the heat transfer section or taken at the negative pressure source.

7. The fluid heater of claim 1, including a sensor configured for detecting the air outflow from the enclosed combustion chamber.

8. The fluid heater of claim 1, wherein the fuel burner is operatively coupled with a fan being configured for causing the air inflow under a positive pressure into the enclosed combustion chamber, and wherein the enclosed combustion chamber is configured for causing the controlled amount of the air inflow under the positive pressure.

9. A fluid heater, comprising:

a. an enclosed combustion chamber, being configured for causing a controlled amount of air inflow into the enclosed combustion chamber;

b. a fuel burner operatively coupled to the enclosed combustion chamber;

c. a first heat transfer section having i. a first end coupled to the enclosed combustion chamber, ii. a second end, iii. an inside wall, iv. an outside wall having a closed cavity therein, v. a fluid input port coupled to the outside wall of the first heat transfer section and in fluid communication with the closed cavity of the first heat transfer section; and a fluid output port coupled to the outside wall of the first heat transfer section and in fluid communication with the closed cavity of the first heat transfer section; and vi. a plurality of tubes, each one of the plurality of tubes having an outside wall, an open first end, an opposite open second end, and an open chamber extending between the open first and second ends of the tube, wherein the plurality of the tubes of the first heat transfer section are mounted within the first heat transfer section so that the outside walls of the plurality of tubes and the inside wall of the first heat transfer section together define the closed cavity of the first heat transfer section;

d. a second heat transfer section having i. a first end coupled to the enclosed combustion chamber, ii. a second end, iii. an inside wall, iv. an outside wall having a closed cavity therein, v. a fluid input port coupled to the outside wall of the second heat transfer section and in fluid communication with the closed cavity of the second heat transfer section, and a fluid output port coupled to the outside wall of the second heat transfer section and in fluid communication with the closed cavity of the second heat transfer section; and vi. a plurality of additional tubes, each one of the plurality of additional tubes having an outside wall, an open first end, an opposite open second end, and an open chamber extending between the open first and second ends of the additional tube, wherein the plurality of the additional tubes of the second heat transfer section are mounted within the second heat transfer section so that the outside walls of the plurality of additional tubes and the inside wall of the second heat transfer section together define the closed cavity of the second heat transfer section;

e. the respective open first ends of the tubes of the first heat transfer section and the respective open first ends of the additional tubes of the second heat transfer section being in fluid communication with the enclosed combustion chamber; and f. a negative pressure source being coupled to the second end of the first heat transfer section, and being in fluid communication with the enclosed combustion chamber by the plurality of the open chambers of the tubes of the first heat transfer section and by the plurality of the open chambers of the additional tubes of the second heat transfer section, and the negative pressure source being configured for causing a controlled amount of air outflow from the enclosed combustion chamber through the tubes of the first heat transfer section and through the additional tubes of the second heat transfer section;

wherein the fluid heater is configured for maintaining a selected amount of air in the enclosed combustion chamber, by the enclosed combustion chamber being configured for causing the controlled amount of the air inflow, together with the negative pressure source being configured for causing the controlled amount of the air outflow through the tubes of the first heat transfer section and through the additional tubes of the second heat transfer section.

10. The fluid heater of claim 9, wherein the enclosed combustion chamber has an outside wall including an enclosed fluid passageway having a fluid input port and a fluid output port, wherein the fluid input port of the enclosed fluid passageway is in fluid communication with the respective fluid output ports of the first and second heat transfer sections, and wherein the fluid heater is configured for causing a heated fluid to flow from the closed cavities of the first and second heat transfer sections to the enclosed fluid passageway.

11. The fluid heater of claim 9, including a sensor configured for detecting the air outflow from the enclosed combustion chamber.

12. The fluid heater of claim 9, further including a microprocessor being operatively coupled to the fuel burner, and to the first heat transfer section, and to the second heat transfer section, and to the negative pressure source; wherein the microprocessor is configured for controlling the air inflow and the air outflow in response to a measurement taken; at the first heat transfer section, or at the second heat transfer section, or at the negative pressure source.

13. The fluid heater of claim 9, further including a microprocessor operatively coupled to the fuel burner, and to the first and second heat transfer sections, and to the negative pressure source.

14. The fluid heater of claim 9, further including a fluid chamber having a fluid input port and a fluid output port and being in proximity to the enclosed combustion chamber, wherein the respective fluid output ports of the first and second heat transfer sections are in fluid communication with the fluid input port of the fluid chamber, and wherein the fluid heater is configured for causing a heated fluid to flow from the respective closed cavities of the first and second heat transfer sections through the fluid chamber, and to thereby cause the heated fluid to be further heated while being in proximity to the enclosed combustion chamber.

15. The fluid heater of claim 9, wherein the negative pressure source includes a fan or a vacuum pump.

16. The fluid heater of claim 9, wherein the fuel burner is operatively coupled with a fan being configured for causing the air inflow under a positive pressure into the enclosed combustion chamber, and wherein the enclosed combustion chamber is configured for causing the controlled amount of the air inflow under the positive pressure.

17. A fluid heater, comprising:

a. an enclosed combustion chamber having an inner wall and a spaced apart outer wall that together define a chamber cavity therebetween, the enclosed combustion chamber being configured for causing a controlled amount of air inflow into the enclosed combustion chamber;

b. a fuel burner operatively coupled to the enclosed combustion chamber;

c. a heat transfer section having an inside wall, the heat transfer section having a tube extending therethrough, wherein i. the tube has an outside wall, and the tube has an open first end being coupled to and in fluid communication with the enclosed combustion chamber, and the tube has an opposite open second end, and ii. the heat transfer section defines a closed cavity between the outside wall of the tube and the inside wall of the heat transfer section, d. a negative pressure source being in fluid communication with the open second end of the tube, and the negative pressure source being configured for causing a controlled amount of air outflow from the enclosed combustion chamber through the tube of the heat transfer section, wherein the fluid heater is configured for maintaining a selected amount of air in the enclosed combustion chamber, by the enclosed combustion chamber being configured for causing the controlled amount of the air inflow, together with the negative pressure source being configured for causing the controlled amount of the air outflow through the tube of the heat transfer section;

wherein the chamber cavity of the enclosed combustion chamber is configured for causing a heated fluid to flow from the closed cavity of the heat transfer section through the chamber cavity, and to thereby absorb heat radiated from the enclosed combustion chamber.

18. The fluid heater of claim 17, further including a microprocessor being operatively coupled to the fuel burner, and to the heat transfer section, and to the negative pressure source; wherein the microprocessor is configured for controlling the air inflow and the air outflow in response to a measurement taken at the heat transfer section or taken at the negative pressure source.

19. The fluid heater of claim 17, further including a microprocessor operatively coupled to the fuel burner, and to the heat transfer section, and to the negative pressure source.

20. The fluid heater of claim 17, wherein the negative pressure source includes a fan or a vacuum pump.

21. The fluid heater of claim 17, further including a second heat transfer section having another tube extending therethrough, wherein a. the another tube in the second heat transfer section has an outside wall, and the another tube has an open first end being coupled to and in fluid communication with the enclosed combustion chamber, and the another tube has an opposite open second end, and b. the second heat transfer section defines a closed cavity between the outside wall of the another tube of the second heat transfer section and the inside wall of the second heat transfer section, wherein the open second end of the another tube in the second heat transfer section is in fluid communication with the negative pressure source.

22. The fluid heater of claim 17, wherein the fuel burner is operatively coupled with a fan being configured for causing the air inflow under a positive pressure into the enclosed combustion chamber, and wherein the enclosed combustion chamber is configured for causing the controlled amount of the air inflow under the positive pressure.

23. The fluid heater of claim 17, including a sensor configured for detecting the air outflow from the enclosed combustion chamber.

* * * * *